United States Patent [19]

Yamasaki et al.

[11] Patent Number: 4,627,698

[45] Date of Patent: Dec. 9, 1986

[54] PROCESSING APPARATUS FOR PRINTING PLATES

[75] Inventors: Masahiro Yamasaki, Otsu; Masayoshi Wakabayashi, Inugamigun; Jun Yamada; Takao Senga, both of Nagaokakyo, all of Japan

[73] Assignee: Dainippon Screen Mfg. Co., Ltd., Tokyo, Japan

[21] Appl. No.: 650,351

[22] Filed: Sep. 13, 1984

[30] Foreign Application Priority Data

Oct. 3, 1983 [JP] Japan ..... 58-185509

[51] Int. Cl.[4] ..... G03D 5/04

[52] U.S. Cl. ..... 354/317; 354/325; 354/328; 15/77; 15/102; 118/109; 118/110

[58] Field of Search ..... 354/317, 324, 325, 328; 15/77, 100, 102; 118/109, 110, 116, 117, 300–326, DIG. 4

[56] References Cited

U.S. PATENT DOCUMENTS

| | | | |
|---|---|---|---|
| 2,313,606 | 3/1943 | Webb et al. | 15/77 |
| 3,448,720 | 6/1969 | Graham | 118/110 |
| 3,608,464 | 9/1971 | Harrell et al. | 354/317 |
| 3,682,078 | 8/1972 | Parker et al. | 118/109 |
| 3,916,426 | 10/1975 | Bown | 354/325 |
| 3,999,511 | 12/1976 | Schwandt et al. | 118/116 |
| 4,091,404 | 5/1978 | Schornig et al. | 354/325 |
| 4,128,326 | 12/1978 | Selak . | |
| 4,215,927 | 8/1980 | Grant et al. | 15/77 |
| 4,327,987 | 5/1982 | Friar et al. | 354/325 |
| 4,331,099 | 5/1982 | Topfer | 354/317 |
| 4,367,940 | 1/1983 | Mart . | |
| 4,428,659 | 1/1984 | Howard | 354/317 |

FOREIGN PATENT DOCUMENTS

| | | |
|---|---|---|
| 357033 | 6/1980 | Austria . |
| 42-21692 | 12/1967 | Japan . |
| 43-14088 | 6/1968 | Japan . |
| 46-33527 | 10/1971 | Japan . |
| 49-47521 | 12/1974 | Japan . |
| 51-9282 | 3/1976 | Japan . |
| 52-562 | 1/1977 | Japan . |
| 53-326 | 1/1978 | Japan . |
| 54-37201 | 3/1979 | Japan . |
| 54-8804 | 4/1979 | Japan . |
| 1164576 | 9/1969 | United Kingdom . |
| 2075372 | 11/1981 | United Kingdom . |
| 2087268 | 5/1982 | United Kingdom . |
| 2120581 | 10/1983 | United Kingdom . |

*Primary Examiner*—A. A. Mathews

*Attorney, Agent, or Firm*—Brumbaugh, Graves, Donohue & Raymond

[57] ABSTRACT

An apparatus for processing a printing plate which comprises an aluminum base and a photoconductive layer on which a toner image is formed, comprises a rotary brush which is arranged so as to be kept in contact with a processing solution and out of contact with a printing plate. The processing solution supplied on the plate surface is regulated to form an even thick flow.

6 Claims, 6 Drawing Figures

PROCESSING APPARATUS FOR PRINTING PLATES

BACKGROUND OF THE INVENTION

This invention relates to a processing apparatus for printing plates, particularly to an apparatus for processing lithographic printing plates having an organic photoconductive layer on which toner images are formed electrophotographically.

As materials for printing plates, presensitized plates or resin plates have been popularly used, and aluminum press plates with organic photoconductive layer through utilization of electrophotographic technology have recently been put in practical use.

With conventional presensitized plates, the irradiated section of the photosensitive layer on the plate surface is hardened by photochemical reaction and is chemically stabilized, and simultaneously the adhesiveness between the irradiated photosensitive layer and the aluminum base on which the photosensitive layer is formed is increased. On the other hand, the non-irradiated section of the photosensitive layer which is not hardened is dissolved or swelled by chemical processing and of which adherence with the aluminum base is released.

An apparatus for developing by using suitable chemicals to the photosensitive characteristics of the presensitized plate as developing solution is so called "PS plate processor".

This processor is ordinarily provided with a friction member such as a rotary brush to remove remaining unhardened (i.e. non-irradiated) section of the photosensitive layer. It is necessary for the PS plate processor that such a physical (mechanical) treatment is used in cooperation with the chemical treatment, because it is difficult to separate the non-reactive (i.e. non-irradiated) section of the photosensitive layer from the reactive (i.e. irradiated) section completely in a short time.

There have been provided various kinds of proposals concerning developing apparatus for lithographic printing plates using the chemical processing and mechanical friction treatment combinationally.

Japanese Patent Publication (Kokoku) Nos. 46-33527 and 49-47521 disclose such apparatus as the plate surface is rubbed by means of a sponge member, whereby the developing solution is supplied thereto and simultaneously dissoluted and swelled photosensitive layer is eliminated. Japanese Utility Model Publication (Kokoku) Nos. 51-9282, 52-562 and 54-8804 and Japanese Utility Model Laid-open (Kokai) Application No. 54-37201 show such apparatus as the dissoluted and swelled photosensitive layer is stripped off by means of frictional rotation of a rotary brush while the developing solution is supplied onto the plate surface. Japanese Patent Publication (Kokoku) No. 53-326 and Japanese Utility Model Publication (Kokoku) Nos. 42-21692 and 43-14088 show a frictional member by which the plate surface is rubbed in cooperation with the chemical processing, which are directed toward reclamation or regulation of the lithographic printing plate.

In these conventional devices or apparatus the physical treatment is performed by means of frictional members, e.g. sponge member or rotary brush, however, when they are applied to a processing apparatus for processing lithographic printing plates having an organic photoconductive layer on which toner images are formed electrophotographically, the resultant printing plate processed can not be satisfactory.

SUMMARY OF THE INVENTION

In view of the foregoing, the primary object of the present invention is to provide a processing apparatus suitable for processing printing plates having an organic photoconductive layer on which toner image is formed electrophotographically. Another object of the invention is to improve the processing speed in a camera direct processing system or a laser direct processing system, particularly to improve the elution velocity of printing plate bearing the toner image thereon.

A further object of the invention is to provide a processing apparatus which ensures the accurate processing result of the plate surface.

The above objects are attained by the present invention, and, according to the invention, the processing apparatus comprises a solution supply pipe from which processing solution is supplied and a regulator member suitable to receive the processing solution supplied from the supply pipe and to flow regulated stream of the solution onto the surface of a printing plate. The regulator member preferably extends laterally in a conveying path of the printing plate, by which the processing solution is regulated to form an even thick flow over the whole surface of the printing plate.

The apparatus according to the invention comprises a rotary brush provided in the lower course of the regulator member. The rotary brush is arranged so as to be kept in contact with the processing solution held on the printing plate and out of contact with the upper surface of the printing plate, by which the chemical reactant species of the processing solution is promoted to osmose and diffuse into the photoconductive layer formed on the upper surface of the printing plate and the product species at the interface of the layer is promoted to disperse therefrom. The rotary brush may be substituted by a roller having a rough peripheral surface and by a brush vibratable horizontally or vertically.

Printing plates to be processed by the processing apparatus of the invention is not of the conventional type such that a photosensitive layer formed on the plate is chemically stabilized by photochemical reaction but of an electrophotographic type, i.e. the chemical stability, in other words the resist effect, is realized by the steps of: charging the photoconductive layer formed on the printing plate, exposing through a negative or positive film which bears a desired image, developing (i.e. tonering) a latent image to obtain a toner image and fixing the toner image. According to the invention, the elution velocity of the printing plate can be greatly improved, which can shorten the total processing time required and can raise the operation efficiency.

Further, the even elution result over the whole printing plate can be obtained, which ensures the accurate processing result.

The processing apparatus according to the invention is free from the bending or folding at edges of the printing plate which was disadvantageously caused by means of a friction member in conventional PS plate processors.

The apparatus is further free from clogging of eluted product into the brush member, which can reduce the maintenance frequency and can lengthen the span of use. Other objects and advantages of the invention will be obvious from the contents of the following description.

DESCRIPTION OF THE PREFERRED EMBODIMENTS

Figure 1:
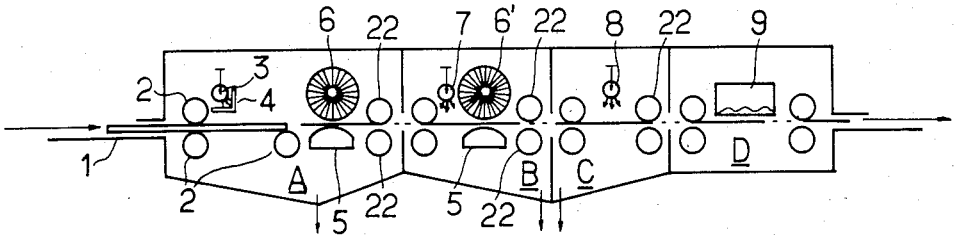
FIG. 1 is a schematic side view of the processing apparatus according to this invention.
Figure 2:
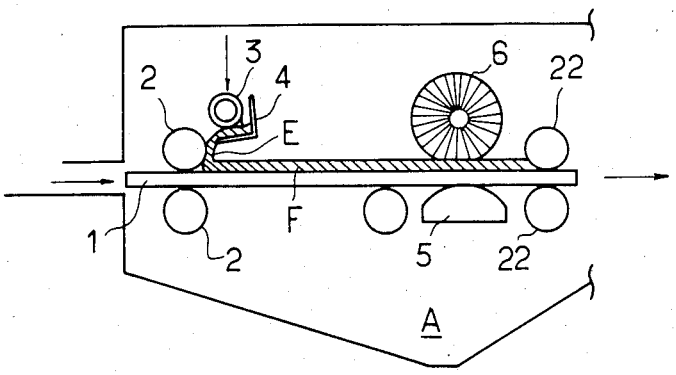
FIG. 2 is a partial diagrammatic view of FIG. 1.

Referring to FIGS. 1 and 2, the printing plate (1) to be processed comprises a base plate (10), e.g. aluminum base, and an organic photoconductive layer (11) which is formed on the base plate. The organic photoconductive layer (11) bears a toner image which is electrophotographically and stably fixed thereon. The printing plate (10) is guided into a processing apparatus while keeping the toner image upward, is subjected to various treatments therein, and, after that, is sent out therefrom.

Referring now to FIG. 1, the printing plate (1) is guided first to a developing unit (A) by carrier rollers (2). Processing solution is supplied from a solution supply pipe (3) which extends laterally over a conveying path of the printing plate and is regulated by means of a regulator member (4) which also extends laterally facing to the supply pipe (3), whereby the processing solution is supplied onto the plate surface as a regulated stream (E). The photoconductive layer of the section excepting the toner image, i.e. non-irradiated section, hereinafter defined as non-resist section, is eluted by means of the supplied solution in cooperation with a stirring member (6), e.g. rotary brush. Detailed explanation on the construction and the processing in the developing unit is given later. The printing plate (1) is then fed into a washing unit (B) by squeegee rollers (22), where washing water is supplied onto the plate surface from the washing water supply member (7), and washing is carried out in cooperation with a rotary brush (6') similar to the rotary brush (6) of the developing unit. Then the printing plate (1) is transferred to a stabilizing unit (C) through squeegee rollers (22).

The rotary brush (6') of the washing unit (B) may be either in contact or out of contact with the plate surface, as there is no need to pay consideration to resist performance of the toner image. It is required in the washing treatment that the chemical reaction in the preceding treatment is immediately stopped, which is important as the processing speed becomes faster. This is also effective to save water when washing water is discharged. In the stabilizing unit (C) hydrophilic solution is supplied onto the plate surface from supply nozzles (8), by which the plate surface gets the hydrophilic property, which is the same manner as for the aluminum surface of the conventional presensitized plate. Then the printing plate (1) is transferred to a drying unit (D) through squeezee rollers (22).

At the drying unit (D), the printing plate (1) is dried by blowing hot air against the plate surface from a drier (9), then is discharged to complete the processing of the lithographic printing plate.

The processing solution, washing water, and stabilizing solution in the processing apparatus shown in FIG. 1 are respectively circulated through a storage tank by means of a circulation pump which are not illustrated in the drawing.

The developing unit (A) in which the elution of the nonresist section of the organic photoconductive layer is performed is further illustrated referring to FIG. 2. The solution supply pipe (3) is provided at the upper part of the developing unit (A), and has multiple holes laterally aligned thereon, from which the processing solution is supplied to the regulator member (4) by which it is regulated to form even thick flow (F) on the plate surface. The regulator member (4) is provided with facing toward the multiple holes, and extends along the supply pipe (3), which is suitable to regulate the processing solution. It is important for the even processing over the plate surface to form the even thick flow of the processing solution on the whole plate surface.

It is generally known that the chemical reaction velocity is dependent on the degree of dispersion of the reactant species to the reaction interface, the degree of concentration of the reactant species at the reaction interface, and also on the partial pressure at the reaction interface. Such reaction factors as dispersion, concentration, and partial pressure become uneven, if the processing solution including the reactant species is supplied foamily or unevenly to the plate surface, e.g. owing to disordered flow, then the resulting plate surface becomes inaccurate, hence unsatisfactory.

Thus in the apparatus according to the invention, the processing solution is continuously supplied to the plate surface by means of the regulator member (4) so as to maintain the surface tension and prevent the above mentioned reaction factors from disturbing. The plate surface is processed in such a manner as it is immersed in the even thick flow of the processing solution.

The chemical reaction of this processing advances from the surface of the organic photoconductive layer into the interior thereof as time elapses, the organic photoconductive layer of the non-resist section is eluted. In this case, it is important for prevention of uneven elution to keep even advancing of the chemical reaction into the interior of the photoconductive layer.

Besides this point, it is also important to form the even thick flow of the processing solution on the plate surface for the predetermined time.

Although the organic photoconductive layer formed on the printing plate to be processed by the apparatus according to this invention is chemicall unstable, which is different from the photosensitive layer of the conventional presensitized plate, it is impossible to promote the chemical reaction velocity at the organic photoconductive layer of the non-resist section only by flowing the processing solution on the photoconductive layer, since the reaction factors such as dispersion, concentration, and partial pressure are limited under the flow of the processing solution.

Thus for promoting the reaction velocity, the apparatus according to the invention is so arranged that the rotary brush (6) is positioned in the developing unit (A) in such a manner as the rotary shaft of the brush (6) traverses over the conveying path and the peripheral end of the brush (6) is kept in contact with the processing solution supplied on the printing plate (1) and is kept out of contact with the printing plate surface.

To enable positioning of this rotary brush (6), a platen (5) is placed opposite to the rotary brush in even and stable contact with the backside of the plate (1) for supporting.

The rotary brush (6) positioned in this manner rotatably stirrs the even thick flow (F) held on the plate surface and causes even fine turbulent flow of the solution on the whole area of the plate surface in cooperation with the horizontal transfer of the plate (1), which makes the effects of the above mentioned reaction factors maximum. Summarizing the test results of this embodiment, the positioning of the rotary brush (6) at the position as mentioned above was practically easily performed, since the processing solution is held by 3 mm to 5 mm thickness on the plate surface.

The elution velocity of the organic photoconductive layer of the non-resist section was promoted up to about 250 mm/min. by using the rotary brush (6), which was greatly improved in comparison with the elution velocity when the rotary brush (6) was not provided, i.e. in which the elution velocity was 60 mm/min. to 100 mm/min. Further it was found that, when a stemming member, e.g. a stationary brush, is provided instead of the rotary brush (6), the elution velocity is higher than that of a conventional presensitized plate.

As for the stemming member, it was more effective that the solution-contacting section is formed like a brush than that like a continuous plate, even in this case the top end of the stemming member must not contact with the plate surface. The reason may be understood that the even thick flow (F) on the plate surface is blocked to cause a turbulent flow by the stemming member, and thus the turbulent flow of the solution effectively acts on the whole surface of the printing plate. It is desirable for causing the even elution over the whole printing plate that the turbulent flow is fine and multiple.

When the rotary brush (6) is kept in contact with the plate surface, the resultant plate surface cannot be satisfactory irrespective of hardness of the rotary brush. Generally, softness of the rotary brush is dependent on the length and diameter of the brush.

On the comparison test between a short brush of 1.0 mm $\phi$ Nylon and a long brush of 0.8 mm $\phi$, the former showed a number of partial defects on the toner image (i.e. resist section) and the later also showed the similar tendency, though slightly.

In either case, therefore, contact of the rotary brush onto plate surface is not desirable.

Figure 3:
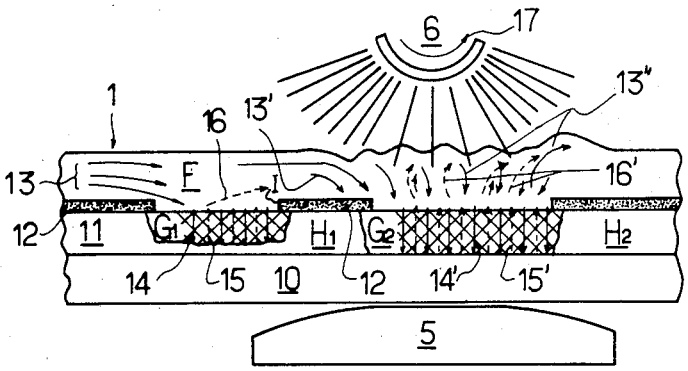
FIG. 3 is an explanatory view of a printing plate surface.

Referring to FIG. 3, the printing plate (1) comprises an aluminum base (10) and an organic photoconductive layer (11) formed thereon, the photoconductive layer (11) being coated with toner layer (12) at the irradiated section by electrophotographic method.

The photoconductive layer (11) at the non-resist section ($G_1$) is eluted only by the even thick flow (F), but is not completed up to the upper surface of the base (10) thereby owing to the limitation of the chemical reaction factors. In other words, when the transfer speed of the printing plate (1) is increased, remaining part of the non-resist section ($G_1$) is held on the plate.

In the case that the non-resist section ($G_1$) is in swelled condition, though it depends on the chemical characteristics of the remaining part of the organic photoconductive layer, the reactant species and the product species run as shown by arrows (13) to (16), i.e. reactant species included in the solution flows along arrows (13) and the reactant species is osmosed as shown by arrows (14), and inversely the diffusion of the product species is performed as shown by arrows (15) and the product species are discharged into the solution flow as shown by arrows (16). When the non-resist section (G) is moved to the rotary brush (6) as the printing plate (1) is transferred, the flow of the solution is made into fine turbulent flow by means of the rotary brush (6), whereby the osmosis of the reactant species and diffusion of the product species are promoted.

In FIG. 3, movements of the reactant species and the product species owing to the fine turbulent flow are respectively shown by arrows (13') and (16'). Thus fresh reactant species are continuously supplied to and concentrated at the interface, and in cooperation with the flow pressure to the plate surface owing to the rotary brush (6), the chemical reaction in the photoconductive layer is intensified further and the non-resist section ($G_2$) is completely eluted up to the surface of the aluminum base (10).

The photoconductive layer of the resist section (H) on which the toner layer (12) is coated is prevented by means of the resist effect of the toner layer from subjecting to chemical reaction because of chemical stability of the toner layer.

Thus the photoconductive layer under the edges of the toner layer (12) is eluted, which is so called "side etch portion". Degree of the side etch portion (I) is greatly dependent on the thickness of the organic photoconductive layer (11) and of the toner layer (12).

Since the thickness of the photoconductive layer (11) is so thin as several microns and that of the toner layer (12) coated onto the photoconductive layer is still thinner, the side etch portion (I) is practically very small. Although the rotary brush tends to hook the toner layer at the side etch portion (I) and to exfoliate the toner layer (12) when the rotary brush is kept in contact with the plate surface, the rotary brush (6) according to the invention is free from such disadvantageous exfoliation of the toner layer.

Figure 4:
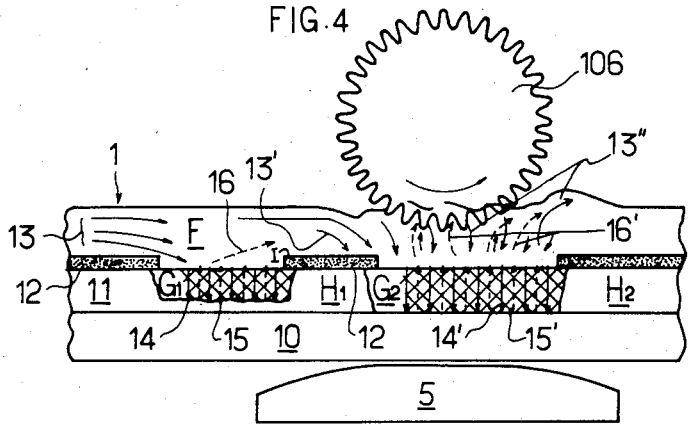
FIGS. 4 through 6 are respectively explanatory view of other embodiments.
Figure 5:
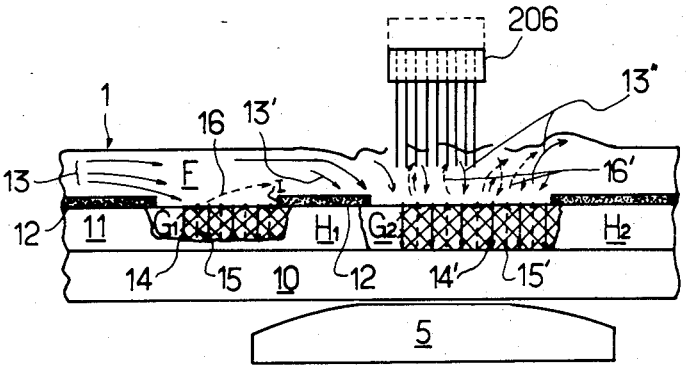
Figure 6:
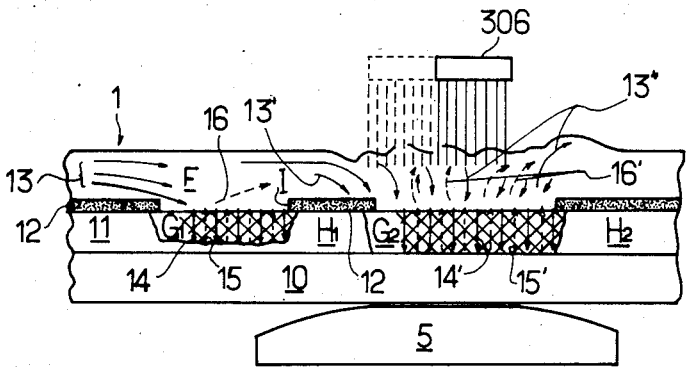

The stirring member is not limited to the rotary brush (6) as shown in FIG. 3, and a stirring roller with rough surface or a vibration member may be applicable instead of the rotary brush (6), as shown in FIGS. 4 through 6. In these embodiments, actions owing to the stirring roller with rough surface (106) are practically same as those in FIG. 3, and the vibration members (206)(306) are respectively vibrated vertically and horizontally, in which the stirring roller and the vibration member are arranged in the same manner as the rotary brush (6), i.e. these are kept in contact with the processing solution and out of contact with the plate surface. As for these embodiments, detailed explanation may not be unnecessary, since any person skilled in the art to which this invention pertains can easily be understood from the drawings.

As many apparently and widely different embodiments of this invention may be made without departing from the spirit and scope thereof, it is to be understood that the invention is not limited to the specific embodiments thereof except as defined in the appended claims.

We claim:

1. An apparatus for processing printing plates which have a base plate and an organic photoconductive layer on which a toner layer is electrophotographically fixed, the apparatus comprising: conveyor means for conveying said printing plate along a conveying path; supply means for supplying a processing solution evenly over the entire width of the upper surface of said printing plate; and stirring means provided along said conveying path subsequent to said supply means, and arranged so as to contact the processing solution on said printing plate without being contactable with said printing plate.

2. An apparatus as defined in claim 1, wherein said supply means includes at least one solution supply pipe provided so that the processing solution is suppliable therefrom, and a regulator member provided so as to extend laterally over said conveying path so as to receive the processing solution supplied from said supply pipe and so that a regulated stream of the processing solution is flowable onto the upper surface of said printing plate from said regulator member, thereby forming an even thick flow over the whole surface of said plate.

3. An apparatus as defined in claim 1, wherein said stirring means includes a rotary brush provided so as to laterally extend in said conveying path, said rotary brush being rotatable at a peripheral speed faster than the flow of the processing solution.

4. An apparatus as defined in claim 1, wherein said stirring means includes a roller having a rough peripheral surface and being provided so as to extend laterally in the conveying path, said roller being rotatable at a peripheral speed faster than the flow of the processing solution.

5. An apparatus as defined in claim 1, wherein said stirring means includes a brush vibratable so as to cause the flow of processing solution to become a fine turbulent flow.

6. An apparatus for processing a printing plate with a processing solution, the printing plate having a base plate and an organic photoconductive layer on which a toner layer of a predetermined image is electrophotographically fixed as a layer resistant to the processing solution, the apparatus comprising: means for conveying the printing plate through the apparatus; means for supplying the processing solution onto the upper surface of the printing plate, said supply means being provided so as to extend across the width of the printing plate so that an even and uniform flow of the processing solution is applied onto the printing plate; and means for processing the printing plate after the processing solution has been supplied thereon, said processing means including means for stirring the processing solution oriented so as to be out of contact with the printing plate, said processing means being provided so as to extend across the width of the printing plate so that an even and uniform processing is provided.

* * * * *

UNITED STATES PATENT AND TRADEMARK OFFICE

CERTIFICATE OF CORRECTION

PATENT NO. : 4,627,698

DATED : December 9, 1986

INVENTOR(S) : Masahiro Yamasaki et al.

It is certified that error appears in the above-identified patent and that said Letters Patent is hereby corrected as shown below:

First page, Item 73, change "Tokyo, Japan" to --Kyoto, and Mitsubishi Paper Mills Ltd., Tokyo, both of Japan--.

Signed and Sealed this

Twenty-fourth Day of March, 1987

*Attest:*

DONALD J. QUIGG

*Attesting Officer*

*Commissioner of Patents and Trademarks*